US006979957B2

(12) United States Patent
Lee et al.

(10) Patent No.: US 6,979,957 B2
(45) Date of Patent: Dec. 27, 2005

(54) APPARATUS FOR DRIVING LAMP OF LIQUID CRYSTAL DISPLAY DEVICE

(75) Inventors: Seok Woo Lee, Seoul (KR); Seung Man Gu, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/720,342

(22) Filed: Nov. 25, 2003

(65) Prior Publication Data

US 2004/0245944 A1 Dec. 9, 2004

(30) Foreign Application Priority Data

Jun. 3, 2003 (KR) ..... 10-2003-0035621

(51) Int. Cl.[7] ..... H05B 37/02
(52) U.S. Cl. ..... 315/195; 315/277; 315/299; 315/308
(58) Field of Search ..... 315/224–226, 315/276–277, 291, 294, 299, 307–308, 194–199

(56) References Cited

U.S. PATENT DOCUMENTS

| | | | | |
|---|---|---|---|---|
| 5,619,402 | A * | 4/1997 | Liu | 363/20 |
| 5,971,567 | A * | 10/1999 | Van Duijneveldt | 362/296 |
| 6,469,453 | B2 * | 10/2002 | Tajika et al. | 315/199 |
| 6,661,181 | B2 * | 12/2003 | Shin | 315/169.4 |
| 6,674,250 | B2 * | 1/2004 | Cho et al. | 315/291 |
| 6,680,588 | B2 * | 1/2004 | Park et al. | 315/312 |
| 2003/0142060 | A1 * | 7/2003 | Lee et al. | 345/102 |
| 2003/0214478 | A1 * | 11/2003 | Yoo et al. | 345/102 |
| 2004/0207339 | A1 * | 10/2004 | Lin et al. | 315/291 |

* cited by examiner

*Primary Examiner*—Thuy Vinh Tran
(74) *Attorney, Agent, or Firm*—McKenna Long & Aldridge LLP

(57) ABSTRACT

The present invention relates to a lamp driving apparatus of a liquid crystal display capable of simplifying a structure of the liquid crystal display and in addition preventing a leakage current of the lamp driving apparatus. The lamp driving apparatus of the liquid crystal display comprises a plurality of lamps, and an inverter block having a plurality of inverters that supply a drive current to the lamps wherein adjacent lamps have a different phase from one another.

16 Claims, 8 Drawing Sheets

APPARATUS FOR DRIVING LAMP OF LIQUID CRYSTAL DISPLAY DEVICE

This application claims benefit of Korean Patent Application No.: P2003-35621, filed on Jun. 3, 2003, which is hereby incorporated by reference for all purposes as if fully set forth herein.

BACKGROUND OF THE INVENTION

1. Field of the Invention

The present invention relates to an apparatus for driving a lamp of a liquid crystal display, and more particularly to an apparatus for driving a lamp of a liquid crystal display capable of simplifying a structure of the liquid crystal display and preventing a leakage current from the apparatus for driving lamp.

2. Description of the Related Art

In general, the scope of application of liquid crystal displays has widened due to the lightweight, thinness, and low power consumption of liquid crystal displays. According to this trend, liquid crystal displays are widely used in an office automation machines and an audio/video machines. The intensity of light beam is adjusted in accordance with a video signal applied to a plurality of control switches arranged in a matrix in order to display a desired picture on a screen.

An LCD needs a light source such as a back light. A cathode fluorescent tube (CCFL) may be used as a light source employed as the back light.

The CCFL is a light source tube using a cold emission phenomenon (the electron emission occurring because a strong electric field is applied to a surface of a cathode.) and is frequently used due to low heat generation, high brightness, long life, and full color reproduction. A CCFL like this has a light guide system, a direct illumination system and a reflection system. So a light source tube is adopted in accordance with a requirement of the LCD. The CCFL may have an inverter circuit for obtaining a high power source from a low power source.

Referring to FIGS. 1 and 2, a lamp driving apparatus of an LCD according to the prior art comprises a lamp housing 10 having a plurality of lamps, an inverter block 20 having a plurality of inverters for supplying a lamp driving voltage to each of the lamps, a first integrated circuit substrate 12 having the inverter block mounted thereon, a current detector 30 having a plurality of current detectors for detecting a tube current in each of the inverters, a second integrated circuit substrate 32 having the current detector 30 mounted thereon and a feedback line 36 connected between the current detector 30 and the inverter block 20 for supplying the inverter block 20 with a feedback signal from the current detector 30.

The lamp housing 10 is provided with a mounting space for mounting a plurality of lamps and is stacked on a main support.

Each of the lamps receives the lamp driving voltage from the inverter block 20 to radiate visible light to a liquid crystal panel (not shown).

The first integrated circuit substrate 12 is located on a lateral portion of the main support 2 and is folded toward a rear surface of the main support 2.

The second integrated circuit substrate 32 is located on another lateral portion of the main support 2 and is folded toward a rear surface of the main support 2. A protecting chassis protects the second integrated circuit substrate 32 and is mounted between the second integrated circuit substrate 32 and the main support 2.

The feedback line 36 connects the first and the second integrated circuit board 12 and 32 that are folded onto the rear surface of the main support. The feedback line 36 may have a plurality of signal wires.

As shown in FIG. 3, each of the inverters in the inverter block 20, comprises a switch circuit 24 for switching a voltage from a voltage source (Vin) in response to a switching control signal, a transformer 22 for converting a voltage supplied by switching of the switch circuit 24 to the lamp driving voltage, a pulse width modulation circuit for controlling the switch circuit 24 in response to the feedback signal (FB) from the current detector 30.

The switch circuit 24 comprises at least one switch device switching a voltage from the voltage source (Vin) to the transformer 22 in response to the switching control signal from the pulse width modulation circuit 26.

The transformer 22 has a primary winding connected to the switch circuit 24 and a secondary winding connected to the lamp 40. The both ends of the primary winding are connected to the switch circuit 24 and one end of the secondary winding is connected to a first electrode terminal of the lamp 40 while the other end is connected to a ground voltage (GND). The transformer 22 converts a voltage supplied to the primary winding by a winding ratio of the first and the secondary winding and induces a voltage into the secondary winding. The voltage induced into the secondary winding is supplied to the lamp 40 through the first electrode terminal of the lamp 40 to turn on/off the lamp 40.

The pulse width modulation circuit 26 controls a switching time period of the switch circuit 24 in response to the feedback signal (FB) from the current detector 30. That is, the pulse width modulation circuit 26 controls the voltage to be supplied to the transformer 22 by controlling the switching time period of the switching circuit 24 in response to the feedback signal (FB).

As shown in FIG. 3, each of the current detectors 31 in the current detector 30, as shown in FIG. 3, is connected between the second electrode terminal of the lamp 40 and the ground voltage source (GND) and supplies the feedback signal (FB) corresponding to a tube current value detected from the lamp 40 to the pulse width modulation circuit 26. To this end, each of the current detectors 30 comprises a first resistor (R1) connected between the second electrode terminal of the lamp 40 and the ground voltage source (GND), a variable resistor (RB) connected between the first resistor (R1) and the ground voltage source (GND), a first diode (D1) connected between the pulse width modulation circuit 26 and the a first node (N1) between the second electrode terminal of the lamp 40 and the first resistor (R1), and a second diode (D2) connected between the ground voltage source (GND) and a second node (N2) between the first node (N1) and the first diode (D1).

The first resistor and variable resistor (R1 and RB) detect a current value of the second electrode terminal of the lamp 40 by a divided resistance and result in a detected signal occur on the first node (N1). The feedback signal (FB) which is the detected signal on the first node (N1) is supplied to the pulse width modulation circuit 26 through the first diode (D1). The second diode (D2) cuts off an impulse of a negative potential and maintains a lowest voltage of the feedback signal (FB) to zero (0) voltage.

In the lamp driving apparatus for an LCD according to the related art, a voltage from the voltage source (Vin) is supplied to the primary winding of the transformer 22 by the switching control of the pulse width modulation circuit 26 of the inverter 20. The voltage supplied to the primary winding of the transformer 22 is converted by the first and the secondary winding ratio of the transformer 22 and is induced into the secondary winding. The current induced at the secondary winding of the transformer 22 is supplied to the lamp and thereby the lamp turns on/off. If the lamp 40 turns on/off, the current detector 30 detects the tube current of the lamp and supplies the feedback signal (FB) corresponding to the detection signal detected to the pulse width modulation circuit 26. Accordingly, the pulse width modulation circuit 26 converts the switching time period of the switch circuit 24 in response to the feedback signal (FB) and controls the voltage supplied to the primary winding of the transformer 22.

As shown in FIG. 4, in the lamp driving apparatus of the LCD according to a related, the lamp driving voltage supplied to a plurality of lamps has the same phase. Accordingly, because the leakage current is large, the power consumption becomes large. In detail, when the phase of the driving current supplied to a plurality of lamps is identical and an impedance of each of the lamps is increased, the leakage current becomes large. The impedance is increased by coupling the current/phase of the adjacent lamps and thereby the leakage current becomes large. Accordingly, the driving of the lamp becomes unstable due to the leakage current of each of the lamps.

In the lamp driving apparatus of an LCD according to the related art, because the current detector 30 is connected to the second electrode terminal of the lamp 40, the feedback line making the current detector 30 and the inverter block 20 electrically connected becomes necessary. As a result, there is disadvantage that the structure of the liquid crystal display becomes complicated.

SUMMARY OF THE INVENTION

Accordingly, the present invention is directed to an apparatus for driving a lamp of a liquid crystal display capable of simplifying a structure of the liquid crystal display and preventing a leakage current in the lamp driving apparatus, that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the lamp driving apparatus of the liquid crystal display according to an aspect of the present invention includes a plurality of lamps; and an inverter block having a plurality of inverters that supply a drive current to the lamps wherein adjacent lamps have a different phase from one another.

The lamp driving apparatus of the liquid crystal display may further include a current detector for detecting the lamp driving current supplied to each of the plurality of lamps in the inverter.

The lamp driving apparatus of the liquid crystal display further may also further include a first common line commonly connected to a second electrode terminal of odd-numbered lamps of the plurality of lamps; a second common line commonly connected to the second electrode terminal of even-numbered lamps of the plurality of lamps; and a ground voltage line for connecting each of the first common line and the second common line to a ground voltage source.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the preferred embodiment of the present invention, example of which is illustrated in the accompanying drawings.

Hereinafter, a preferred embodiment of the present invention is described with reference to FIGS. 5 to 8.

Figure 1:
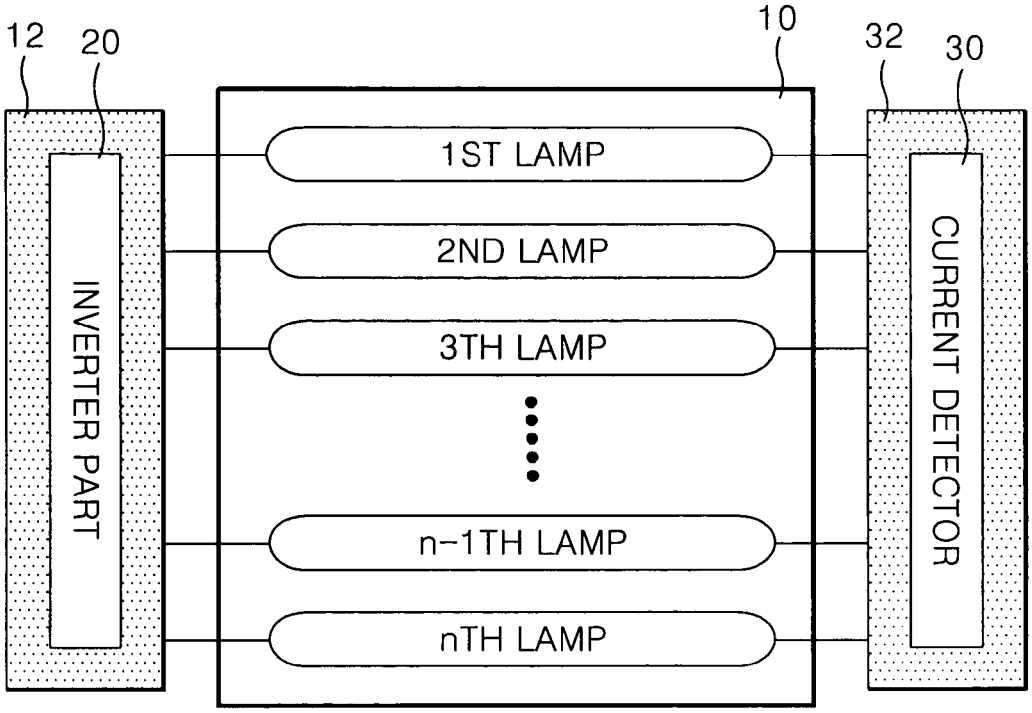
FIG. 1 RELATED ART
FIG. 1 is a plane view illustrating a lamp driving apparatus of a liquid crystal display according to related art.
Figure 2:
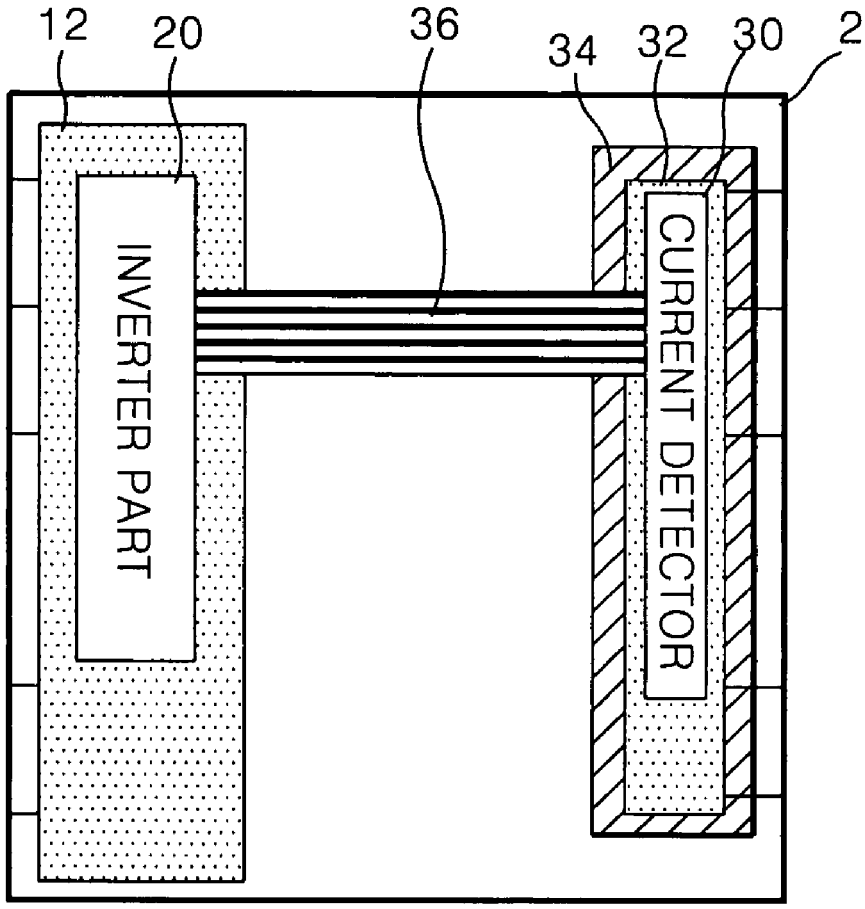
FIG. 2 RELATED ART
FIG. 2 is a rear view illustrating a lamp driving apparatus of a liquid crystal display according to related art.
Figure 3:
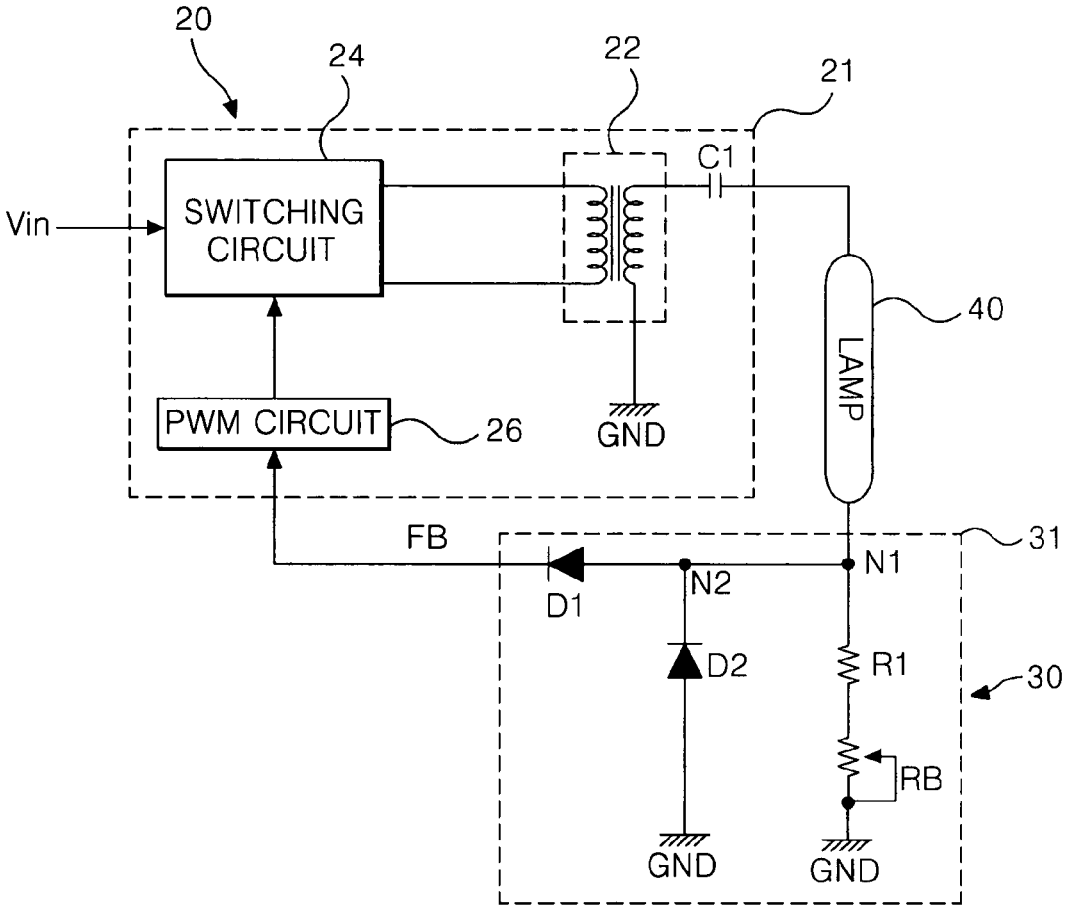
FIG.3 RELATED ART
FIG. 3 is a circuit diagram schematically illustrating a lamp driving apparatus of a liquid crystal display shown in FIGS. 1 and 2.
Figure 4:
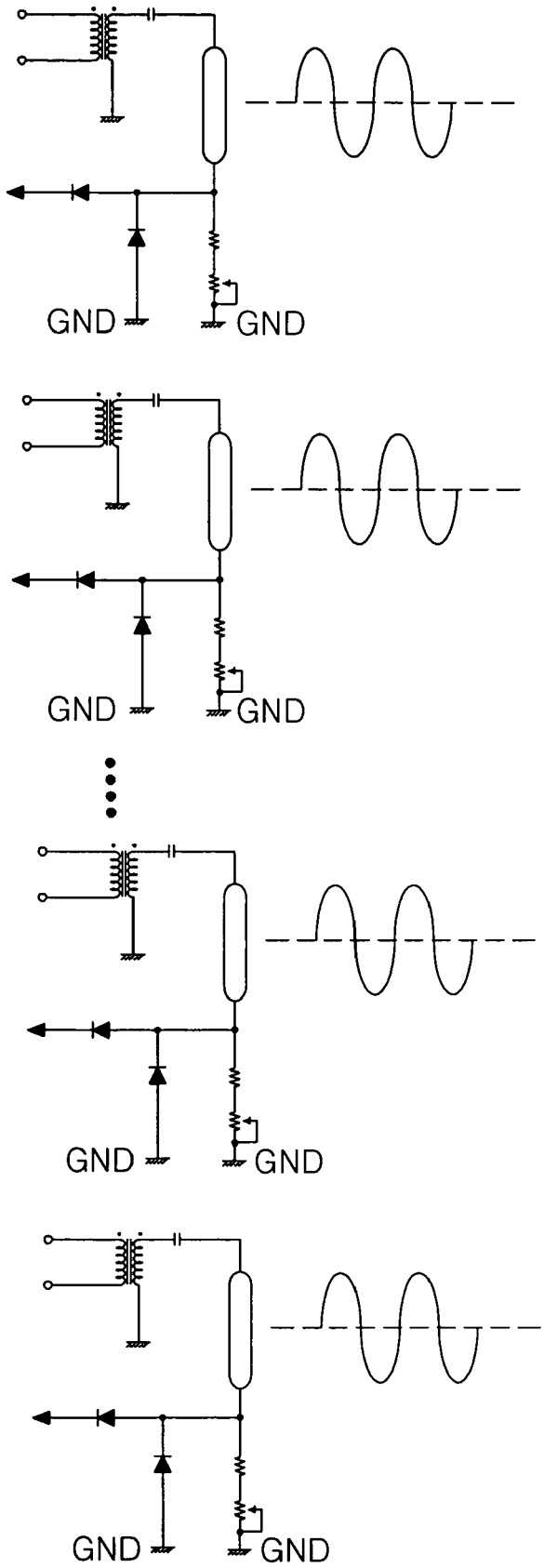
FIG. 4 RELATED ART
FIG. 4 is a diagram illustrating the phase of a current supplied to each of a plurality of lamps shown in FIG. 1.
Figure 5:
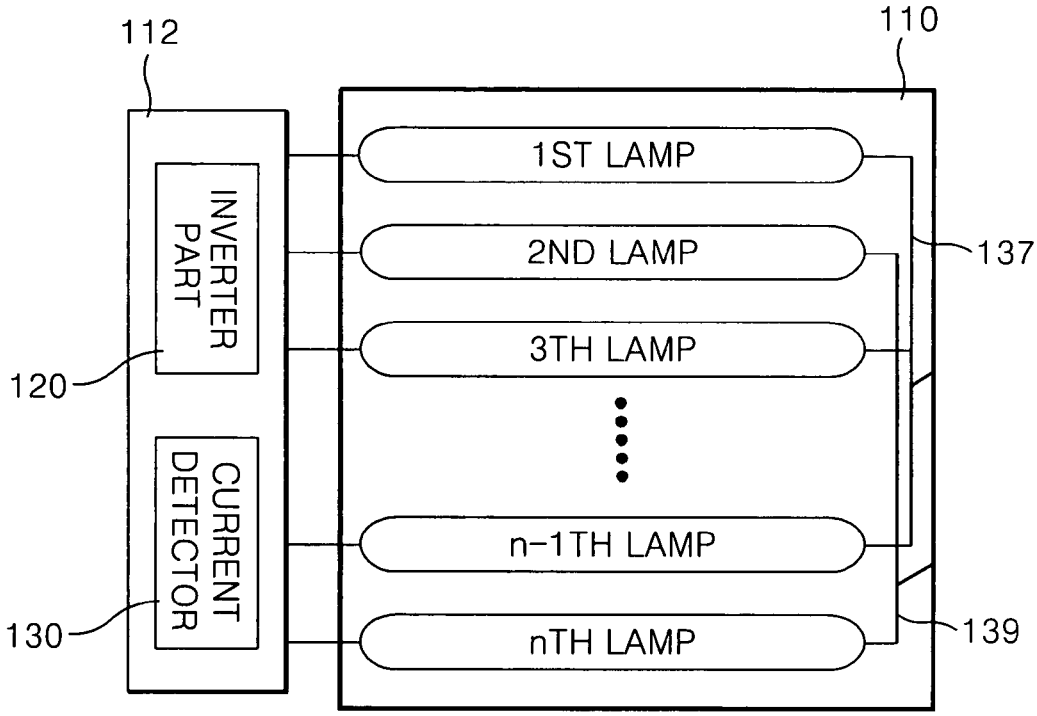
FIG. 5 is a plane view illustrating a lamp driving apparatus of a liquid crystal display according to an embodiment of the present invention.
Figure 6:
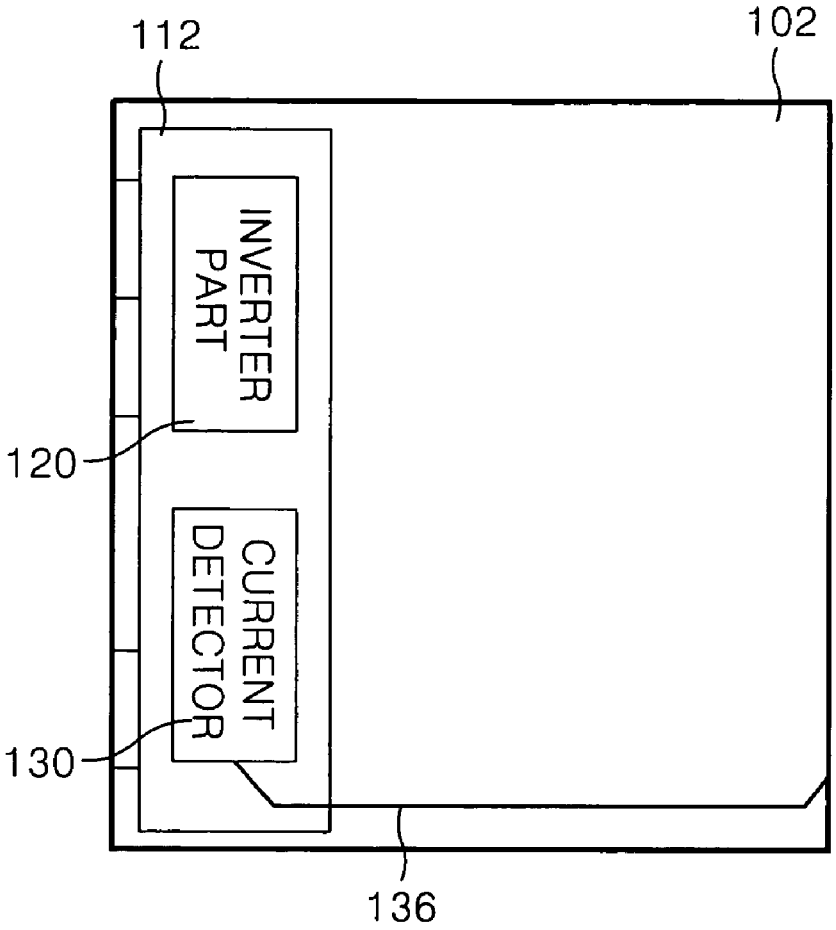
FIG. 6 is a diagram illustrating a rear view of a lamp driving apparatus of a liquid crystal display according to an embodiment of the present invention.

Referring to FIGS. 5 and 6, a lamp driving apparatus of a liquid crystal display according to an embodiment of the present invention comprises a lamp housing 110 accommodating a plurality of lamps, an integrated circuit board 112 having an inverter block 120 having a plurality of inverters for supplying a lamp driving voltage to each pair of lamps and a current detector 130 having a plurality of current detecting devices for detecting a tube current supplied by each of inverters and having a ground voltage line 136 for connecting each of lamps to a ground voltage source (GND).

The lamp housing is provided with space to accommodate and mount a plurality of lamps and is stacked on a main support 102.

Each of the lamps receives the lamp driving voltage from the inverter block 120 and radiates visible light to a liquid crystal panel (not shown). A first electrode terminal of each of the lamps is connected to the inverter block 120 and a second electrode terminal thereof is connected to a ground voltage source (GND). In this connection, the second electrode terminal of each of odd-numbered lamps of the lamps is commonly connected to a first common line 137 and then is connected to a ground voltage source (GND) of the integrated circuit substrate 112 through the ground voltage line 136. The second electrode terminal of each of even-numbered lamps is commonly connected to a second common line 139 and then is connected to the ground voltage source (GND) of the integrated circuit substrate 112 through the ground voltage line 136.

The integrated circuit substrate 112 is located at one side of the main support and is folded to the rear of the main support 102.

The ground voltage line 136 makes each of the lamps electrically connected to the integrated circuit substrate 112 folded in the rear of the support main 102. The ground voltage line 136 has at least two signal wires.

Figure 7:
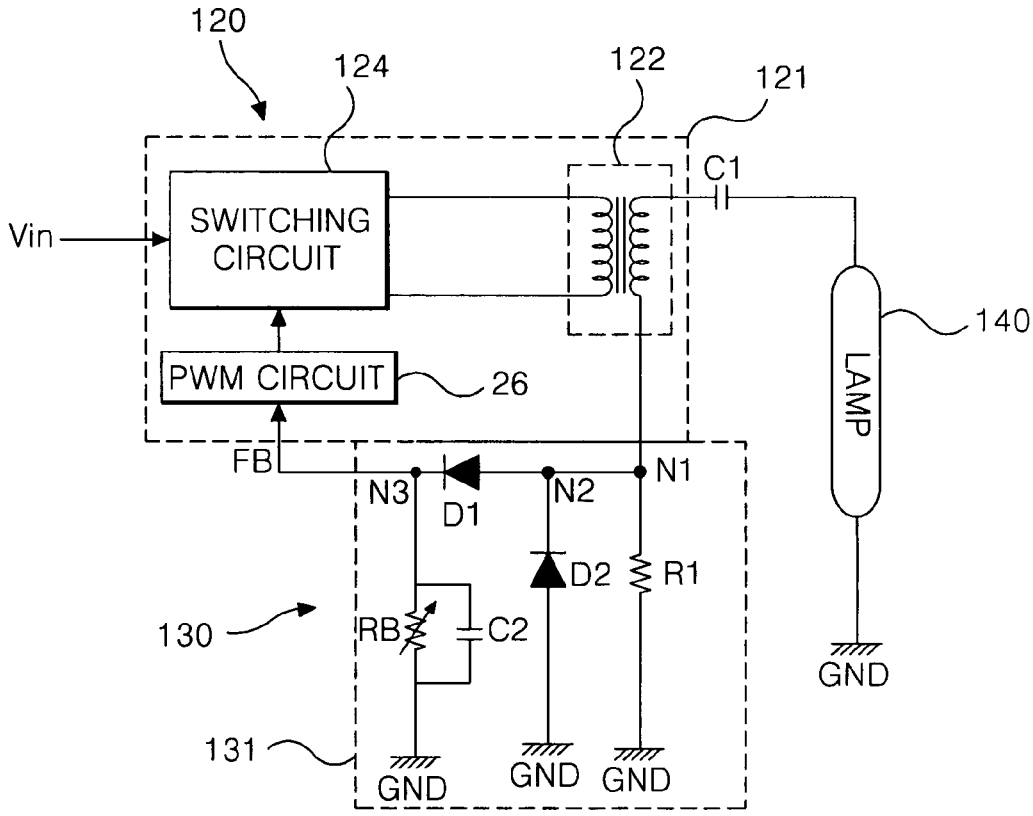
FIG. 7 is a circuit diagram schematically illustrating a lamp driving apparatus of a liquid crystal display shown in FIGS. 5 and 6.

Each of the inverters 121 comprising the inverter block 120, as shown in FIG. 7, includes a switch circuit 124 for switching a voltage from the voltage source (Vin) in response to a switching control signal, a transformer 122 for converting a voltage supplied to the switch circuit 124 into the lamp driving voltage and a pulse width modulation circuit 126 for controlling the switch circuit 124 in response to the feedback signal (FB) from the current detector 130.

The switch circuit 124 comprises at least one switch device for switching a voltage from the voltage source (Vin) into the transformer in response to a switch control signal from the pulse width modulation circuit 126. In addition capacitors may be connected in series or parallel (not shown) to an output terminal of the switch circuit 124 in accordance with a circuit driving scheme.

The transformer 122 comprises the primary winding connected to the switch circuit 124 and the secondary winding connected to the lamp 140. Both terminals of the primary winding are connected to the switch circuit 124 and one terminal of the secondary winding is connected to a first electrode terminal of the lamp 140 and the other terminal is connected to the current detector 130. The transformer 122 converts a voltage supplied to the primary winding by a winding ratio of the primary and the secondary windings to induce a voltage on the secondary winding. The voltage induced on the secondary winding is supplied to the lamp 140 through the first electrode terminal of the lamp 140 to turn on/off the lamp 140.

More specifically, one set of transformers 122 supply a current having a first phase to the odd-numbered lamps, and a second set of transformers 122 supply a current having a second phase to the even-numbered lamps. That is, the transformers 122 connected to the odd-numbered lamps provides a current having a positive phase, and the transformer 122 connected to the even-numbered lamps provides a current having a reverse phase. To this end, the primary and the secondary windings of the transformer 122 connected to the odd-numbered lamps are wound in the same direction while the primary and the secondary windings of the transformer 122 connected to the even-numbered lamps are wound in an opposite direction.

On the other hand, a first capacitor (C1) is connected between the secondary winding of the transformer 122 and the first electrode terminal of each of the plurality of lamps and a second capacitor (C2) may be selectively employed in accordance with the circuit driving scheme.

The pulse width modulation circuit 126 is a controller that controls the switching period of the switch circuit 124 in response to the feedback signal (FB) from the current detector 130. That is, the pulse width modulation circuit 123 controls the switching time period of the switch device 120 in response to the feedback signal to control a voltage supplied to the transformer 122.

As shown in FIG. 7, each of the current detectors 131 in the current detector 130, supplies to the pulse width modulation circuit 126 the feedback signal (FB) corresponding to a current value supplied to the lamp 140 by the secondary winding of the transformer 122. To this end, each of the current detectors 131 comprises a first resistor (R1) connected between the secondary winding of the transformer 122 and the ground voltage source (GND), a first diode (D1) connected between the pulse width modulation circuit 126 and a first node (N1) between the first resistor (R1) and the secondary winding of the transformer 122, a second diode (D2) connected between the ground voltage source (GND) and the second node (N2) between the first node (N1) and the first diode (D1), a variable resistor (RB) connected between the ground voltage source (GND) and the third node (N3) between the first diode (D1) and the pulse width modulation circuit 126 and the second capacitor (C2) connected in parallel to the variable resistor (RB).

The first resistor (R1) detects a current value of the secondary winding of the transformer 122 and the detected current value appears as a detection signal on the first node (N1). The feedback signal (FB) which is the detection signal on the first node (N1) is supplied to the pulse width modulation circuit 126 through the first diode (D1). The second diode (D2) cuts off an impulse of the negative potential to maintain a minimum potential of the feedback signal (FB) to zero potential. The combination of the variable resistor (RB) and the second capacitor (C2) converts the potential of the feedback signal (FB) through the first diode (D1) into a direct current level and supplies the direct current to the pulse width modulation circuit 126.

As described above, the lamp driving apparatus of the liquid crystal display according to an embodiment of the present invention supplies a voltage from the voltage source (Vin) to the primary winding of the transformer by switching of the switch circuit 124 controlled by the pulse width modulation circuit 126 of the inverter 120. The voltage supplied to the transformer 122 is converted by the winding ratio of the first and the second windings of the transformer 122 and is induced on the secondary winding. The current induced on the secondary winding of the transformer 122 is supplied to the lamp 140 to thereby turn on the lamp 140. When the lamp 140 is turned on, the current detector 130 detects a current induced on the secondary winding of the transformer 122 and supplied to the first electrode terminal of the lamp 140, the current detector 130 and supplies the feedback signal (FB) corresponding to the detection signal detected by the pulse width modulation circuit 126. Subsequently, the pulse width modulation circuit 126 converts the switching time period of the switch circuit 124 in response to the feedback signal (FB) and controls the voltage to be supplied to the primary winding of the transformer 122.

Figure 8:
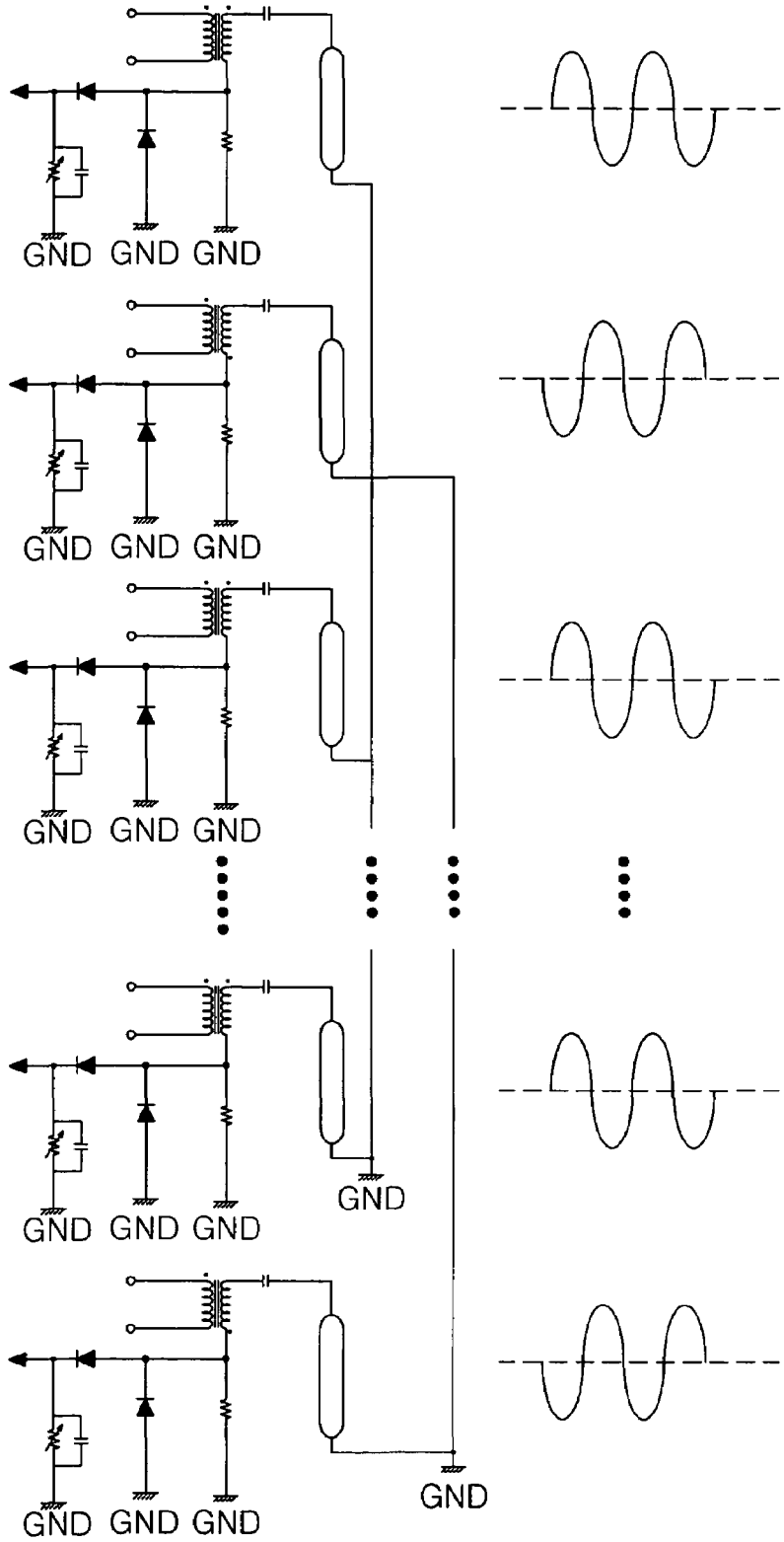
FIG. 8 is a diagram illustrating a phase of a current supplied to each of a plurality of lamps shown in FIG. 5.

As shown in FIG. 8, in the lamp driving apparatus of the liquid crystal display according to an embodiment of the present invention, the lamp driving voltage supplied to the plurality of lamps has an inverse phase relationship between adjacent lamps. Therefore, the leakage current becomes zero (0) in each of the lamps and thereby the power consumption is reduced. The driving current supplied to the adjacent lamps of the plurality of lamps has an inverse phase relationship so the leakage current of adjacent lamps have an inverse phase relationship, therefore, these adjacent leakage currents cancel each other resulting in a zero leakage current. Further, because an increase of an impedance due to a current/phase coupling between the adjacent lamps becomes zero (0) by the current overlap, the leakage current becomes zero.

As shown in FIG. 7, on the other hand, the lamp driving apparatus of the liquid crystal display according to the embodiment of the present invention, as shown in FIG. 7, does not need a special integrated circuit substrate and a protecting chassis for mounting the current detector such as that of the related art, because the current detector 130 is connected to the secondary winding of the transformer 122. Accordingly, the structure of the present invention is simplified.

As described above, the lamp driving apparatus of the liquid crystal display according to the embodiment of the present invention comprises the transformer supplying the lamp driving current having the inverse phase to the adjacent lamps of the plurality of lamps and the current detector for detecting the tube current of each of the plurality of lamps as being connected to the secondary winding of the transformer. Accordingly, the present invention may stably drive a plurality of lamps. Further, the structure of the liquid crystal display may be simplified.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A lamp driving apparatus of a liquid crystal display, comprising:

a plurality of lamps; and an inverter block having a plurality of transformers that convert a voltage from a voltage source into a drive current and supply the current to the plurality of lamps wherein a primary winding and a secondary winding of the transformers that supply current to the odd-numbered lamps are wound in the same direction and a primary winding and a secondary winding of the transformers that supply current to the even-numbered lamps are wound in the opposite direction from each other such that the odd-numbered lamps have a different phase from the even-numbered lamps.

2. The lamp driving apparatus of the liquid crystal display according to claim 1, further comprising a current detector block that detects the lamp drive current supplied to each of the plurality of lamps from the inverter block.

3. The lamp driving apparatus of the liquid crystal display according to claim 2, wherein the inverter block further comprises:

a plurality of switching circuits that switch the voltage into the plurality of transformers; and a plurality of controllers controlling the switching circuits with reference to a feedback signal from the current detector block.

4. The lamp driving apparatus of the liquid crystal display according to claim 3, wherein the current detector block is connected to the secondary windings of the transformers.

5. The lamp driving apparatus of the liquid crystal display according to claim 3, wherein the current detector block includes a plurality of current detectors, each current detector within the current detector block comprising:

a resistor connected between the secondary winding of a transformer and a ground voltage source;

a first diode connected between a control block and a first node between the secondary winding of the transformer and the resistor;

a variable resistor connected between the ground voltage source and a node between the first diode and the control block; and a capacitor connected in parallel to the variable resistor.

6. The lamp driving apparatus of the liquid crystal display according to claim 5, wherein each of the current detectors in the current detector block further comprises:

a second diode connected between the ground voltage source and the node between the first node and the first diode.

7. The lamp driving apparatus of the liquid crystal display according to claim 2, further comprising an integrated circuit substrate on which the inverter block and current detector block are mounted, the integrated circuit substrate being folded towards a rear surface of the liquid crystal display.

8. The lamp driving apparatus of the liquid crystal display according to claim 1, further comprising:

a first common line commonly connected to a second electrode terminal of each odd-numbered lamp of the plurality of lamps;

a second common line commonly connected to a second electrode terminal of each even-numbered lamp of the plurality of lamps; and a ground voltage line connecting the first common line and the second common line to a ground voltage source.

9. A lamp driving apparatus of a liquid crystal display, comprising:

a plurality of lamps including a plurality of odd-numbered lamps and a plurality of even-numbered lamps; and an inverter block having a first plurality of transformers that convert a voltage from a voltage source into a drive current and supply the drive current to the plurality of lamps, wherein the plurality of transformers that supply the drive current to the even-numbered lamps have a first phase and the plurality of transformers that supply the drive current to the odd-numbered lamps have a phase opposite the first phase; and wherein a primary winding and a secondary winding of the transformers that supply current to the odd-numbered lamps are wound in the same direction and a primary winding and a secondary winding of the transformers that supply current to the even-numbered lamps are wound in the opposite direction from each other.

10. The lamp driving apparatus of the liquid crystal display according to claim 9, further comprising a current detector block that detects the lamp drive current supplied to each of the plurality of lamps from the inverter block.

11. The lamp driving apparatus of the liquid crystal display according to claim 10, further comprising an integrated circuit substrate on which the inverter block and current detector block are mounted, the integrated circuit substrate being folded towards a rear surface of the liquid crystal display.

12. The lamp driving apparatus of the liquid crystal display according to claim 10, wherein the inverter block comprises:

a plurality of switching circuits that switch the voltage into the plurality of transformers; and a plurality of controllers controlling the switching circuits with reference to a feedback signal from the current detector block.

13. The lamp driving apparatus of the liquid crystal display according to claim 12, wherein the current detector block is connected to the secondary windings of the transformers.

14. The lamp driving apparatus of the liquid crystal display according to claim 12, wherein each current detector in the current detector block comprises:

a resistor connected between a secondary winding of the transformer and a ground voltage source;

a first diode connected between a control block and a first node between the secondary winding of the transformer and the resistor;

a variable resistor connected between the ground voltage source and a node between the first diode and the control block; and a capacitor connected in parallel to the variable resistor.

15. The lamp driving apparatus of the liquid crystal display according to claim 14, wherein each current detector in the current detector block further comprises a second diode connected between the ground voltage source and the node between the first node and the first diode.

16. The lamp driving apparatus of the liquid crystal display according to claim 9, further comprising:

a first common line commonly connected to a second electrode terminal of each odd-numbered lamp of the plurality of lamps;

a second common line commonly connected to a second electrode terminal of each even-numbered lamp of the plurality of lamps; and a ground voltage line connecting the first common line and the second common line to a ground voltage source.

* * * * *